US005662246A

United States Patent [19]

Contaxis, III

[11] Patent Number: 5,662,246

[45] Date of Patent: Sep. 2, 1997

[54] TAMPER-DETERRENT NOZZLE FOR PUMP DISPENSERS

[75] Inventor: William Contaxis, III, Middletown, Conn.

[73] Assignee: Owens-Illinois Closure Inc., Toledo, Ohio

[21] Appl. No.: 538,667

[22] Filed: Oct. 3, 1995

[51] Int. Cl.[6] ..... B67D 5/33

[52] U.S. Cl. ..... 222/153.07; 222/153.14

[58] Field of Search ..... 222/153.07, 153.14, 222/383.1; 239/333, 538; 215/250, 254

[56] References Cited

U.S. PATENT DOCUMENTS

| | | | |
|---|---|---|---|
| 4,204,614 | 5/1980 | Reeve | 222/153.14 |
| 4,257,561 | 3/1981 | McKinney | 222/153.14 |
| 4,971,227 | 11/1990 | Knickerbocker et al. | 222/153.07 |
| 5,040,701 | 8/1991 | Knickerbocker et al. | 222/153.07 |
| 5,050,779 | 9/1991 | Knickerbocker | 239/333 |
| 5,169,032 | 12/1992 | Steijns et al. | 222/153.07 |
| 5,535,952 | 7/1996 | Tada | 239/333 |

*Primary Examiner*—Philippe Derakshani

[57] ABSTRACT

A pump dispenser has a body defined by a top wall and a front end and a nozzle cap rotatably mounted on the body. The cap, which must be rotated for the nozzle to operate, has an opening in a side wall thereof adjacent the front end. An elongate blocking tab has a rear portion unitary with and connected to said top wall, and a middle portion extends forwardly from the rear portion and is disposed in the opening in the nozzle cap. The tab also has a forward finger-grippable portion extending forward from said middle portion. The middle portion, by being in the opening, prevents rotary movement of the nozzle cap until the blocking tab is torn from the top wall.

9 Claims, 2 Drawing Sheets

TAMPER-DETERRENT NOZZLE FOR PUMP DISPENSERS

BACKGROUND OF THE INVENTION

This invention relates to a tamper-deterrent and-evident nozzle for a pump dispenser. More specifically, the invention relates to a pump dispenser in which a tear-away tab on the body of the dispenser extends into an opening in the dispenser nozzle cap so that the dispenser is inoperable until the tear-away tab is torn away from the dispenser.

The art includes a number of pump-type hand-held sprayer dispensers having tamper-deterrent means, a example of which is Steijns et al U.S. Pat. No. 5,169,032 issued Dec. 8, 1992. Steijns et al provides a separately made pop-in tamper-evident piece with a rearward pull and which in assembly is pushed in to an opening snap-fastener fashion in the top wall of the sprayer. It includes two legs which extend down through openings in the body and cap into the area between the front end of the sprayer and the cap. These legs, when the piece is in place, block the turning of the nozzle cap by engagement with notches and keep the sprayer "off". The legs also go down inside the walls of the body to hold prongs outward and prevent the squeezing together of the side walls and the inward movement of blocking prongs. To operate the sprayer the piece must be pulled up and detached from the sprayer body.

Knickerbocker et al U.S. Pat. No. 4,971,227 issued Nov. 20, 1990, provides a tear strip which is attached by little bridges to the nozzle cap and holds it against rotation with respect to the body. Alternatively, the strip may be attached to the body and overlie the cap. When the tear strip is torn off, the cap is turnable.

Knickerbocker U.S. Pat. No. 5,050,779 issued Sep. 24, 1991, provides a spring-board-like tab fitting in an opening in the cap which make it difficult for a child to turn the cap. Said tab must be sprung outwardly as in FIG. 6 and the cap turned at the same time.

Knickerbocker et al U.S. Pat. No. 5,040,702 issued Aug. 20, 1991, has an encircling tear band having shoulders which engage protrusions on the body so that the cap cannot be turned until the tear band is removed.

Reeve U.S. Pat. No. 4,204,614 issued May 27, 1980, has a spring-biased tab which must be pressed down in order to turn the cap.

Finally, the McKinney patent U.S. Pat. No. 4,257,561 issued Mar. 24, 1981 shows an arrangement similar to Reeve '614 except that here a forward tab fits into an opening in the cap to prevent turning until the tab is pressed down.

There is a need for a dispenser nozzle in which a blocking tab, extending forward and unitary with a wall of the pump, blocks operation of the pump until it is removed.

SUMMARY OF THE INVENTION

Briefly, the invention is a fluid dispensing device for mounting on a container comprising a body having a top wall portion and a front end. A nozzle assembly comprises a nose bushing at the front end of the body and a nozzle cap rotatably mounted thereon, the cap having an opening in a side wall thereof adjacent the front end of the body. The invention also comprises an elongate blocking tab having a rear portion unitary with and connected to said top wall portion of the body rearward of said front end. The tab has a middle portion extending forwardly from the rear portion and disposed in the opening in the nozzle cap. The tab also has a forward finger-grippable portion extending forward from said middle portion, said middle portion, by being in the opening, prevents relative movement between the nozzle cap and the body until the blocking tab is torn from the top wall.

BRIEF DESCRIPTION OF THE DRAWINGS

Other objects and features of the invention will be apparent to those skilled in the art from a study of the following specification and drawings, all of which disclose non-limiting forms of the invention. In the drawings.

DESCRIPTION OF THE PREFERRED EMBODIMENT

Figure 1:
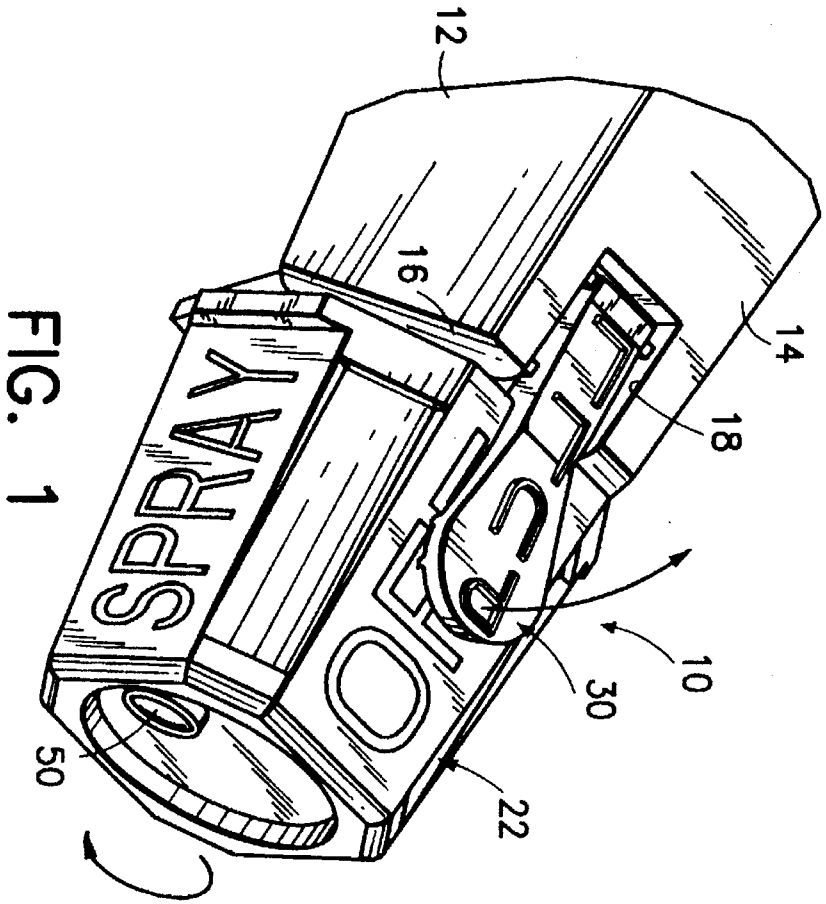
FIG. 1 is a fragmentary perspective view of the nozzle portion of a pump dispenser embodying the invention.

The nozzle area of a pump dispenser embodying the invention is generally designated 10 in FIG. 1. It comprises a dispenser body 12 having a top wall portion 14 and a front end 16. Adjacent the front end the top wall portion is formed with a rearwardly extending notch 18.

Figure 3:
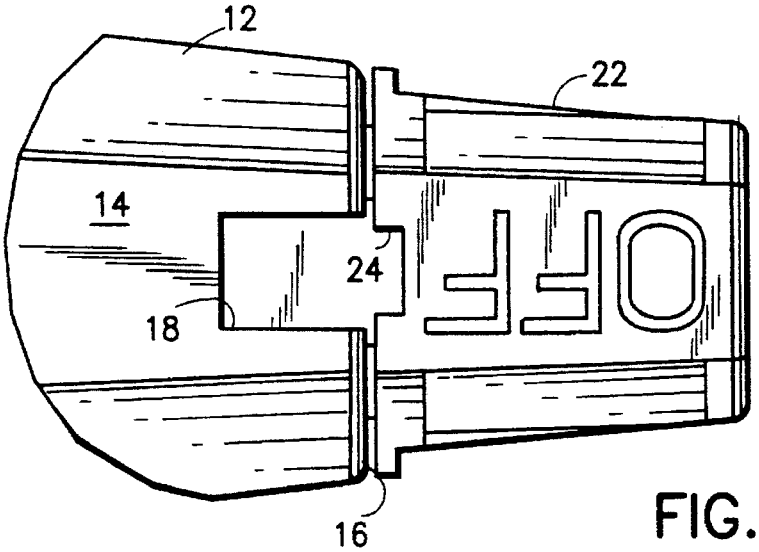
FIG. 3 is a view similar to FIG. 2 with the blocking tab torn away.
Figure 4:
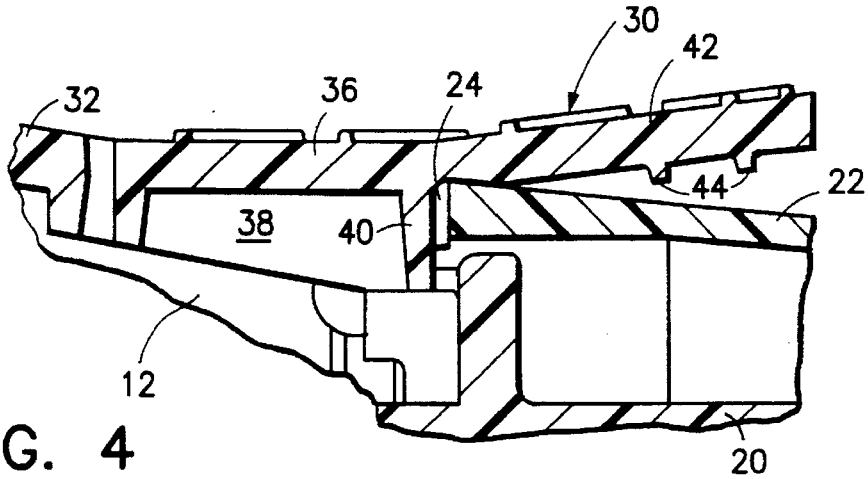
FIG. 4 is a fragmentary sectional view taken on the line 4—4 of FIG. 2.
Figure 5:
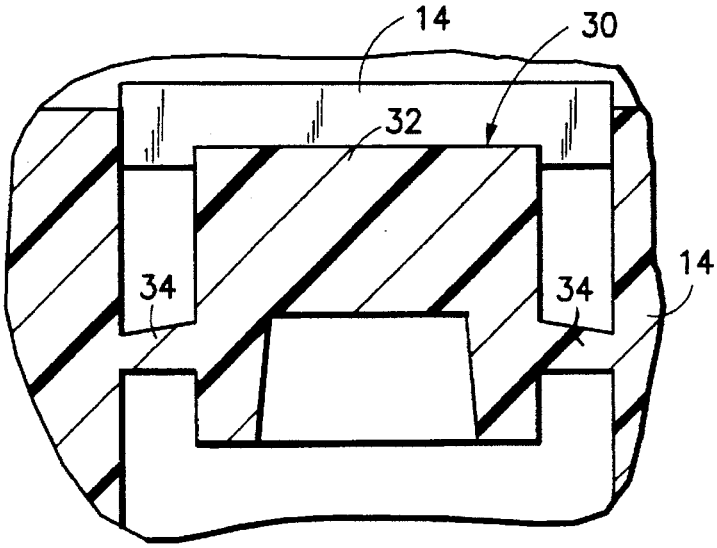
FIG. 5 is an enlarged fragmentary sectional view taken on the line 5—5 of FIG. 2.

As is conventional, the body 12 (FIG. 4) is formed with a nozzle bushing 20 which is tubular (not shown) and extends forward from the body. Rotatably mounted on the bushing 20 by means well known in the art is the nozzle cap 22. As best shown in FIG. 3 the rear end of the side of the cap is formed with a forwardly extending opening 24.

The internal structure of the bushing and cap are such that unless the cap is rotated relative to the body 12 from the "off" position, flow of the liquid through the nozzle is blocked. This is as well known in the art, for instance, in the McKinney patent U.S. Pat. No. 4,257,561.

Formed with the top wall 14 of the body is the blocking tab 30. The tab comprises a rear portion 32 which is attached to the top wall 14 by pairs of bridges 34 which are spaced therealong. Extending forward from the rear portion 32 is the middle portion 36. This portion has downward side flanges 38 (FIG. 4) and front flange 40 of which extend, to some extent as shown, into the opening 24 in the nozzle cap.

Finally, the tab extends forward from the middle portion 36 to the forward finger-grippable portion 42 comprising the distal end of the tab. Transverse ridges 44 may be formed in the underside of the forward portion 44 to provide better gripping.

With the middle portion 36 disposed in the opening 24 of the nozzle cap, it will be clear that the cap cannot rotate and remains in the "off" position. Indeed, it is only after the front portion 42 is pulled upward and rearward to tear the tab away from the wall, fracturing the bridges 34, that the middle portion is removed from the opening 24 and the cap 22 can be rotated to other rotary positions. At these positions, for instance, the discharge through the nozzle orifice 50 is possible and may be selectively be "spray" or "stream".

Figure 2:
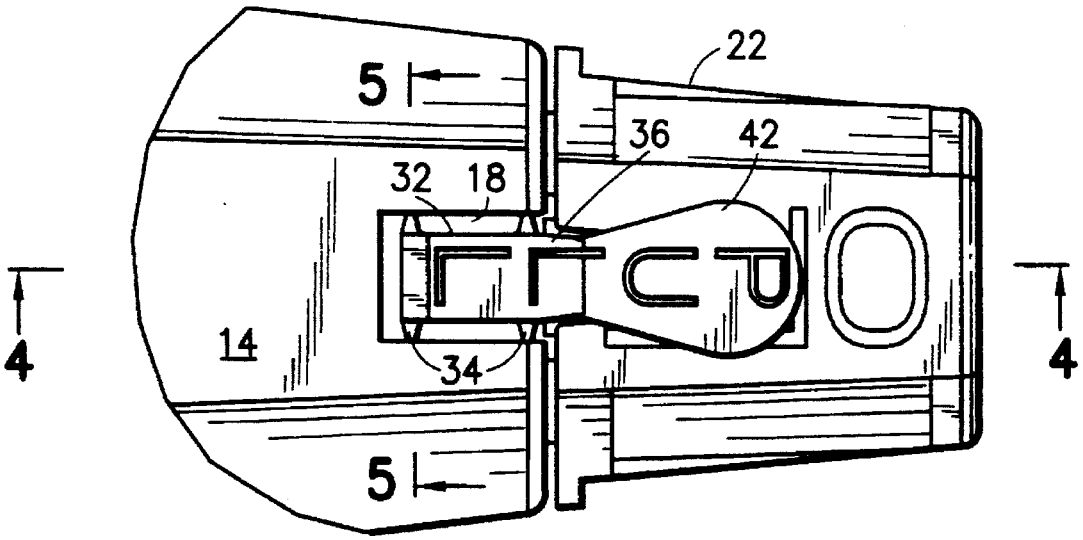
FIG. 2 is a top plan view thereof.

It will be clear that the present invention imparts at once a clear understanding to the user that the tab which extends forward to partially obscure the nozzle must be torn away before the dispenser is usable (FIG. 2). At the same time, whether the tab is intact or removed indicates whether the dispenser is unused or used. Because the tab is generally flush with the wall, it presents a streamlined appearance.

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. A hand-operated dispenser for mounting on to a container, said dispenser comprising;

a. a pump body having a wall portion and a front end;

b. a nozzle assembly comprising a nose bushing at said front end of said body and a nozzle cap rotatably mounted on said nose bushing, the cap having an opening in a side thereof adjacent the front end of the body, c. an elongate blocking tab having a rear portion unitary with and detachably connected to said wall portion of said body rearwardly of said front end, said tab having a middle portion extending forwardly from said rear portion and disposed in said opening in the nozzle cap, the tab having a forward finger-grippable portion extending forward from said middle portion, said middle portion, by being in the opening, preventing rotary movement between said nozzle cap and said body until said forward portion is pulled upwardly and rearwardly to tear said blocking tab from said wall portion and move said middle portion out of the opening in said nozzle cap.

2. A hand-operated fluid dispenser as claimed in claim 1 wherein the rear portion of the tab is attached to said wall portion by frangible bridges unitary with the tab and spaced along the wall portion.

3. A hand-operated dispenser as claimed in claim 2 wherein the wall portion is a top wall portion and the rear portion of the tab is disposed in a notch in the top wall portion and the top surface of the rear portion is at the level of the top surface of the top wall portion.

4. A hand-operated dispenser as claimed in claim 3 wherein the notch and the rear portion of the tab are generally rectangular.

5. A hand-operated dispenser as claimed in claim 3 wherein the opening in the nozzle cap is a notch in the rear of the cap side wall.

6. A hand-operated dispenser as claimed in claim 5 wherein the notch on the top wall portion and the notch on the cap are aligned.

7. A hand-operated dispenser as claimed in claim 2 wherein the bridges comprise two spaced bridges on one side of the rear portion aligned with two spaced bridges on opposite sides of the rear portion respectively.

8. A hand-operated dispenser as claimed in claim 1 wherein the tab is a substantially planar element.

9. A method of initially deterring the use of a pump dispenser having a body with a forward nozzle bushing and a nozzle cap having an axis which must be rotated on the bushing to make the dispenser operable, including the steps of:

a. providing a notch in the body adjacent the cap, the notch having side walls parallel to the axis of the nozzle cap and providing an opening in the cap adjacent the notch, b. forming unitarily with the body in the notch a tear-away tab connected to the body by frangible bridges spaced along the side walls of the notch, c. extending the tab forwardly from the notch into the opening, and d. further extending the tab over the nozzle cap.

* * * * *